US008691141B2

(12) United States Patent
Murakami et al.

(10) Patent No.: US 8,691,141 B2
(45) Date of Patent: Apr. 8, 2014

(54) LOW CARBON RESULFURIZED FREE CUTTING STEEL

(75) Inventors: Toshiyuki Murakami, Miyagi (JP); Kunikazu Tomita, Miyagi (JP); Tetsuo Shiraga, Miyagi (JP)

(73) Assignee: JFE Bars and Shapes Corporation, Tokyo (JP)

( * ) Notice: Subject to any disclaimer, the term of this patent is extended or adjusted under 35 U.S.C. 154(b) by 31 days.

(21) Appl. No.: 12/998,897

(22) PCT Filed: Dec. 9, 2009

(86) PCT No.: PCT/JP2009/070594

§ 371 (c)(1),
(2), (4) Date: Jun. 14, 2011

(87) PCT Pub. No.: WO2010/071060

PCT Pub. Date: Jun. 24, 2010

(65) Prior Publication Data

US 2011/0243786 A1 Oct. 6, 2011

(30) Foreign Application Priority Data

Dec. 16, 2008 (JP) ..... 2008-319334

(51) Int. Cl.
*C22C 38/60* (2006.01)

(52) U.S. Cl.
USPC ..... 420/87; 420/88; 148/320

(58) Field of Classification Search
USPC ..... 420/87, 88, 84; 148/320
See application file for complete search history.

(56) References Cited

U.S. PATENT DOCUMENTS

| | | | | |
|---|---|---|---|---|
| 3,973,950 | A * | 8/1976 | Itoh et al. | 420/84 |
| 4,615,730 | A * | 10/1986 | Tommaney | 420/71 |
| 4,686,081 | A * | 8/1987 | Takashima et al. | 420/29 |
| 4,806,304 | A * | 2/1989 | Kimura et al. | 420/84 |
| 6,649,125 | B2 * | 11/2003 | Hayaishi et al. | 420/87 |
| 7,666,350 | B2 * | 2/2010 | Yaguchi et al. | 420/87 |

FOREIGN PATENT DOCUMENTS

| | | | |
|---|---|---|---|
| JP | 1-309946 | A | 12/1989 |
| JP | 7-173573 | A | 7/1995 |
| JP | 7-173574 | A | 7/1995 |
| JP | 9-176799 | A | 7/1997 |
| JP | 10-158781 | A | 6/1998 |
| JP | 2000-160284 | A | 6/2000 |
| JP | 2005-059096 | A | 3/2005 |
| JP | 2008-138260 | A | 6/2008 |

* cited by examiner

*Primary Examiner* — Scott Kastler
*Assistant Examiner* — Michael Aboagye
(74) *Attorney, Agent, or Firm* — Holtz, Holtz, Goodman and Chick, PC

(57) ABSTRACT

A low carbon resulfurized free cutting steel consisting of 0.04 to 0.15% of C, more than 0.10% and 0.70% or less of Si, 0.85 to 1.50% of Mn, 0.040 to 0.120% of P, 0.250% or more and less than 0.400% of S, less than 0.005% of Al, more than 0.0020% and 0.0120% or less of O, and more than 0.0070% and 0.0150% or less of N, all by mass percentage, and the balance of Fe and inevitable impurities, and satisfying a formula (1) and a formula (2), as follows:

$$0.15\% \leq Si\,\% + 2 \times P\,\% - (5 \times Al\,\% + 10 \times O\,\% + 3 \times N\,\%) \leq 0.75\% \quad (1), \text{ and}$$

$$([Mn\,\%]^5)/15 < S\,\% < ([Mn\,\%]^5)/2 \quad (2).$$

14 Claims, No Drawings

LOW CARBON RESULFURIZED FREE CUTTING STEEL

This application is the United States national phase application of International Application No. PCT/JP2009/070594 filed on Dec. 9, 2009.

TECHNICAL FIELD

The present invention relates to a low carbon resulfurized free cutting steel, which contains sulfur serving as an element for improving the machinability.

BACKGROUND ART

The resulfurized free cutting steel contains a large amount of oxygen to control the form of sulfide effective in machinability, i.e., to make the form of sulfide like a spindle. However, since all the oxygen cannot be dissolved in the sulfide, it is unavoidable for gigantic oxide to be formed so as to cause streak flaws, thereby generating surface flaws in the hot rolling step.

As techniques for solving the phenomena described above, there are proposed techniques that decrease the amount of oxide by lowering the oxygen content or lowering the content of Si serving as a deoxidizing agent (Patent Documents 1, 2, and 3). Further, there is proposed a technique that increases the dissolved oxygen by, increasing the amount of sulfide (Patent Document 4).

Patent Document 1 discloses a free cutting steel that contains a decreased quantity of gigantic oxide inclusions, while the oxygen content is set to be 0.008% or less. This document discloses that, in order to prevent the machinability from being deteriorated due to the lower oxygen content, an element for improving the form of sulfurized substances (sulfide) or an element for improving the machinability is added, or the rolling temperature is controlled. Consequently, the form of sulfurized substances (sulfide) is further improved, so that internal defects and/or flaws are prevented from being generated due to the gigantic oxide inclusions.

Patent Document 2 discloses a Pb-added free cutting steel applicable to shafts for OA equipment. This document discloses a component composition where the content of Si, which lowers the cleanliness of steel ingots, is set to be 0.1% or less, so as to decrease the amount of oxide. Further, in this composition, Cr content is set at 11.0% to mainly ensure the corrosion resistance, while the content of S, which deteriorates the corrosion resistance and hot workability, is set to be 0.01% or less.

Patent Document 3 discloses a low carbon resulfurized free cutting steel having good machinability. This document discloses a chemical component where the Si content is set to be 0.1 mass % or less, because $SiO_2$, which is hard oxide harmful to the machinability, is remarkably increased if the Si content exceeds 0.1 mass %.

Patent Document 4 discloses an inexpensive free cutting steel to which Pb is not added. This document discloses a chemical component where a large amount of S is added to increase the total volume of sulfide, so as to greatly improve the free-cutting capability in the Pb-non-added type with lower Si and higher P. Further, the Mn/S is set to be larger than a certain value to prevent the hot workability from being deteriorated.

The free cutting steel disclosed in Patent Document 1 sets the oxygen content to be 0.008 mass % or less, but this merely decreases the oxygen content, and cannot sufficiently control the form of sulfide, thereby allowing the sulfide to be elongated. The free cutting steels disclosed in Patent Documents 2 and 3 set the Si content to be 0.1 mass % or less, but this merely utilizes S as a deoxidizing agent, and thus is not directed to a component composition with a particularly attention to improve the machinability. Further, the free cutting steel disclosed in Patent Document 4 contains a large amount of S, but the form of sulfide is not controlled.

Accordingly, the free cutting steels disclosed in Patent Documents 1 to 4 are still insufficient in machinability.

[Patent Document 1]
Jpn. Pat. Appln. KOKAI Publication No. 1-309946
[Patent Document 2]
Jpn. Pat. Appln. KOKAI Publication No. 9-176799
[Patent Document 3]
Jpn. Pat. Appln. KOKAI Publication No. 7-173574
[Patent Document 4]
Jpn. Pat. Appln. KOKAI Publication No. 2000-160284

DISCLOSURE OF INVENTION

An object of the present invention is to provide a low carbon resulfurized free cutting steel having a sufficient machinability and thus fewer surface flaws.

The present inventors conducted assiduous researches on the issues described above, and have arrived at the findings given below.

(1) Where the oxygen content is decreased in the component composition of steel, Si is not consumed to produce gigantic oxide but is dissolved in the ferrite structure, which occupies a large percentage of the parent phase structure. Consequently, the steel increases its hardness and thereby becomes brittle to improve the finished surface roughness and the chip manageability.

Where the required level of the finished surface roughness is high, this effect is significant and can compensate for deterioration in machinability at least to the extent caused by sulfurized substances (sulfide) elongated due to the smaller oxygen content.

(2) Based on the relationship between the machinability and the surface flaw generation due to oxide, a suitable value of the Si content is defined by use of an index of Si %+2×P %−(5×Al %+10×O %+3×N %). According to this formula, the Al content utilized as a deoxidizing agent as in Si is also defined at the same time. Further, based on the relationship between the machinability and the surface flaw generation, the strain ageing and the N content relating to the production of AlN precipitated substances are also defined at the same time. Furthermore, the content of P that acts on the machinability in a way similar to that of Si is also defined at the same time.

(3) Where the S content in the component composition is defined by use of an index of $([Mn\ \%]^5)/15<S\ \%<([Mn\ \%]^5)/2$, the effect of the sulfide of improving the machinability is remarkably enhanced.

The present invention has been made on the basis of the findings described above along with additional studies.

Specifically, according to the present invention, there is provided a low carbon resulfurized free cutting steel consisting of 0.04 to 0.15% of C, more than 0.10% and 0.70% or less of Si, 0.85 to 1.50% of Mn, 0.040 to 0.120% of P, 0.250% or more and less than 0.400% of S, less than 0.005% of Al, more than 0.0020% and 0.0120% or less of O, and more than 0.0070% and 0.0150% or less of N, all by mass percentage, and the balance of Fe and inevitable impurities, and satisfying a formula (1) and a formula (2), as follows:

$$0.15\% \leq Si\ \% + 2 \times P\ \% - (5 \times Al\ \% + 10 \times O\ \% + 3 \times N\ \%) \leq 0.75\% \quad (1), \text{ and}$$

$$([Mn\ \%]^5)/15 < S\ \% < ([Mn\ \%]^5)/2 \quad (2).$$

BEST MODE FOR CARRYING OUT THE INVENTION

An explanation will be given of reasons for limitations on the components of steel according to the present invention. In the following explanation, "%" means "mass percentage".

C: 0.04 to 0.15%

Since C seriously affects the strength and the machinability of the steel, C is an important element. If the C content is less than 0.04%, it is difficult to obtain a sufficient strength, and it is expected to deteriorate the finished surface roughness, which belongs to the machinability, due to high ductility. On the other hand, if the C content exceeds 0.15%, it is expected to deteriorate the finished surface roughness due to an excessive amount of pearlite. Accordingly, the C content is set to be 0.04 to 0.15%.

Where the C content is around 0.15%, austenite grains become larger during the solidification in the casting step, and the hot workability of the cast piece surface is thereby deteriorated. Consequently, flaws are generated on the cast piece surface and are left even after the subsequent rolling step is finished. Thus, the steel suffers a deterioration in surface flaws. Accordingly, the C content is preferably set to be less than 0.10%.

Si: more than 0.10% and 0.70% or less

Since Si is dissolved in the ferrite structure that occupies a large percentage of the parent phase structure, and increases the hardness and thereby makes the steel more brittle, it is expected to improve the finished surface roughness and the chip manageability. However, if the Si content is 0.10% or less, this effect cannot be sufficient. On the other hand, if the Si content exceeds 0.70%, this effect is saturated, and it is expected to produce gigantic Si oxide in the casting step. The gigantic Si oxide generates therefrom surface flaws in the subsequent rolling step. Accordingly, the Si content is set to be more than 0.10% and 0.70% or less. The Si content is preferably set to be less than 0.50%.

Mn: 0.85 to 1.50%

Mn is a sulfide formation element important for the machinability. However, if the Mn content is lower than 0.85%, the amount of sulfide becomes too small to obtain a sufficient level of the machinability. On the other hand, if the Mn content exceeds 1.50%, the sulfide is elongated too much, and the machinability is thereby lowered. Accordingly, the Mn content is set to be 0.85 to 1.50%.

P: 0.040 to 0.120%

P is an element effective for suppressing the formation of the built-up edge in the cutting step or making the ferrite structure brittle so as to lower the finished surface roughness. However, if the P content is lower than 0.040%, it is difficult to sufficiently obtain the effect. On the other hand, if the P content exceeds 0.120%, the effect described above is saturated, and the hot workability is markedly lowered and thereby deteriorates the surface flaws. Accordingly, the P content is set to be 0.040 to 0.120%. The P content is preferably set to be 0.100% or less.

S: 0.250% or more and less than 0.400%

S is a sulfide formation element effective on the machinability. However, if the S content is less than 0.250%, the amount of sulfide becomes too small to obtain a sufficient effect on the machinability. On the other hand, if the S content is 0.400% or more, the hot workability is lowered and a large number, of surface flaws are generated in the rolling step. Accordingly, the S content is set to be 0.250% or more and less than 0.400%.

Al: less than 0.005%

As Al is utilized as a deoxidizing agent, Al is an element to be easily oxidized. Al produces gigantic Al oxide in the steel in the casting step. The gigantic Al oxide generates therefrom surface flaws in the subsequent rolling step. Further, Al unites with N to form AlN, which is precipitated at the austenite grain boundary. Consequently, the hot workability is lowered and surface flaws are generated in the rolling step. Accordingly, in order to reduce surface flaws generated in the rolling step due to the gigantic Al oxide or precipitated AlN, the Al content is set to be less than 0.005%.

O: more than 0.0020% and less than 0.0120%

O is an element effective for suppressing elongation of the sulfide in a hot working step, such as the rolling step. Therefore, O is an element important for improving the machinability by this function. However, if the O content is 0.0020% or less, it is difficult to obtain a sufficient effect of suppressing elongation of the sulfide. In this case, since the elongated sulfide remains, it cannot be expected for the sulfide to provide a sufficient effect of improving the machinability. On the other hand, O produces gigantic oxide in the casting step, which generates therefrom surface flaws in the subsequent rolling step, and thus it is harmful to set the O content to exceed a certain level. If the O content is 0.0120% or more, surface flaws are generated in the rolling step due to the gigantic oxide produced in the casting step, as described above. Accordingly, the O content is set to be more than 0.0020% and less than 0.0120%. The O content is preferably set to be less than 0.0090%, and more preferably to be less than 0.0050%.

N: more than 0.0070% and 0.0150% or less

N is an element effective for causing the strain ageing of the steel material in the cutting step. Therefore, N is an element important for improving particularly the finished surface roughness and chip manageability, both of which belong to the machinability, by this function. However, if the N content is 0.0070% or less, it is difficult to obtain a sufficient function of causing the strain ageing of the steel material, and thus it cannot be expected to obtain a sufficient effect of improving the machinability. On the other hand, N produces AlN precipitated at the austenite grain boundary, which lowers the hot-work ductility, and generates surface flaws in the rolling step. If the N content exceeds 0.0150%, it is harmful. Accordingly, the N content is set to be more than 0.0070% and 0.0150% or less.

$$Si\ \% + 2 \times P\ \% - (5 \times Al\ \% + 10 \times O\ \% + 3 \times N\ \%): 0.15 \text{ to } 0.75\%$$

The index of $Si\ \% + 2 \times P\ \% - (5 \times Al\ \% + 10 \times O\ \% + 3 \times N\ \%)$ is an important index relating to the basis of the present invention. This index defines the balance of the Si content, P content, Al content, O content, and N content in the component composition to improve the surface roughness and to reduce the surface flaws, so as to achieve an excellent machinability.

Specifically, the technical meaning of this index is to achieve optimization based on the balance between (1) the Si content, P content, O content, and N content in light of the machinability, and (2) the Si content, Al content, O content, and N content in light of production of the oxide and precipitated AlN that deteriorates the surface flaws.

If this index is less than 0.15%, it is difficult to sufficiently obtain the effect. On the other hand, if this index exceeds 0.75%, this effect is saturated, and it becomes difficult to reduce the surface flaws generated in the rolling step due to the gigantic oxide produced in the casting step. Accordingly, the index of Si %+2×P %−(5×Al %+10×O %+3×N %) is set to be 0.15 to 0.75%. In this index, each of the element symbols means the element content.

$$([Mn\ \%]^5)/15<S\ \%<([Mn\ \%]^5)/2$$

Further, according to the present invention, the balance between the Mn content and S content is defined by an index of $([Mn\ \%]^5)/15<S\ \%<([Mn\ \%]^5)/2$, to suppress generation of the surface flaws and to improve the machinability. In the case of $S\ \% \leq ([Mn\ \%]^5)/2$, sulfides, such as FeS, other than MnS is formed and deteriorates the surface flaws. On the other hand, in the case of $S\ \% \leq ([Mn\ \%]^5)/15$, remaining Mn unused for MnS formation unnecessarily increases the hardness of the steel material, and deteriorates particularly the tool service life. Accordingly, it is set to satisfy $([Mn\ \%]^5)/15<S\ \%<([Mn\ \%]^5)/2$, and preferably to satisfy $S\ \%<([Mn\ \%]^5)/3.5$. In this index, each of the element symbols means the element content.

The low carbon resulfurized free cutting steel according to the present invention may be utilized such that a cast piece is manufactured from molten steel in accordance with a conventional method to have a component composition falling within the range of the present invention, and is then subjected to a hot rolling step in accordance with a conventional method to form a round bar steel, square bar steel, or shaped steel having predetermined dimensions.

The low carbon resulfurized free cutting steel prepared as described above has a small surface roughness and an excellent machinability with a few surface flaws, and thus is industrially very useful.

Present Example

Next, an explanation will be given of present examples according to the present invention.

Table 1 shows steel samples having a chemical component composition within the range of the present invention (each of which will be referred to as a present invention steel sample (PS)) Nos. 1 to 21, along with steel samples having a chemical component composition outside the range of the present invention (each of which will be referred to as a comparative steel sample (CS)) Nos. 22 to 40 and a reference sample (RS) No. 41 consisting of SUM23L. Each of these steel samples was smelted and then casted into an ingot having a casting cross sectional area of 400 mm×300 mm. Then, the ingot was subjected to a hot rolling step to form a steel rod having a diameter of 85 mm and a steel wire having a diameter of 11.5 mm. Then, the steel rods and steel wires thus manufactured from the present invention steel samples, comparative steel samples, and reference sample were respectively subjected to the following experiments.

Experiment 1

Tests Using the Steel Rods

A machinability test was performed by use of conditions and examinations shown in Table 2. A surface flaw test was conducted by preparing a round bar cut in a length of 300 mm, then acid-washing the round bar, and then measuring the number of surface flaws thereon by visual inspection. Table 3 shows results of these tests.

As compared to the reference sample (RS) No. 41 consisting of SUM23L, each of the present invention samples (PS) Nos. 1 to 21 rendered a smaller number of surface flaws, i.e., a better performance on the surface flaws, and also rendered a better performance on the machinability including the chip manageability and finished surface roughness.

The samples Nos. 22 to 40 are comparative samples (CS). The sample No. 22 was set to have a C content of less than 0.04%, which is outside the claimed range of the C content according to the present invention. Consequently, the sample No. 22 rendered an insufficient strength and a high ductility, resulting in a worse performance on the machinability as compared to the present invention steel samples.

The sample No. 23 was set to have a C content of more than 0.15%, which is outside the range of the C content according to the present invention. Consequently, the sample No. 23 rendered a lager amount of pearlite, resulting in a worse performance on the machinability as compared to the present invention steel samples.

The sample No. 24 was set to have an Si content of 0.1% or less, which is outside the range of the Si content according to the present invention. Consequently, the sample No. 24 rendered a high ductility of the ferrite structure, resulting in a worse performance on the machinability as compared to the present invention steel samples.

The sample No. 25 was set to have an Si content of more than 0.7%, which is outside the range of the Si content according to the present invention. Consequently, the sample No. 25 rendered generation of streak flaws due to gigantic Si oxide, resulting in a larger number of surface flaws, i.e., a worse performance on the surface flaws as compared to the present invention steel samples.

The sample No. 26 was set to have an Mn content of less than 0.85%, which is outside the range of the Mn content according to the present invention. Consequently, the sample No. 26 rendered a smaller amount of sulfide, resulting in a worse performance on the machinability as compared to the present invention steel samples.

The sample No. 27 was set to have an Mn content of more than 1.50%, which is outside the range of the Mn content according to the present invention. Consequently, the sample No. 27 rendered an elongation of sulfide, resulting in a worse performance on the machinability as compared to the present invention steel samples.

The sample No. 28 was set to have a P content of less than 0.040%, which is outside the range of the P content according to the present invention. Consequently, the sample No. 28 rendered failures in suppressing the formation of the built-up edge and in making the ferrite structure brittle, resulting in a worse performance on the machinability as compared to the present invention steel samples.

The sample No. 29 was set to have a P content of more than 0.120%, which is outside the range of the P content according to the present invention. Consequently, the sample No. 29 rendered a remarkable deterioration in hot workability, resulting in a larger number of surface flaws, i.e., a worse performance on the surface flaws as compared to the present invention steel samples.

The sample No. 30 was set to have an S content of less than 0.250%, which is outside the range of the S content according to the present invention. Consequently, the sample No. 29 rendered an insufficient amount of sulfide, resulting in a worse performance on the machinability as compared to the present invention steel samples.

The sample No. 31 was set to have an S content of 0.400% or more, which is outside the range of the S content according to the present invention. Consequently, the sample No. 31 rendered a remarkable deterioration in hot workability, resulting in a larger number of surface flaws, i.e., a worse performance on the surface flaws as compared to the present invention steel samples.

The sample No. 32 was set to have an Al content of 0.005% or more, which is outside the range of the Al content according to the present invention. Consequently, the sample No. 32 rendered generation of streak flaws due to gigantic Al oxide and a deterioration in hot workability due to AlN precipitated at the austenite grain boundary, resulting in a larger number of surface flaws, i.e., a worse performance on the surface flaws as compared to the present invention steel samples.

The sample No. 33 was set to have an O content of 0.0020% or less, which is outside the range of the O content according to the present invention. Consequently, the sample No. 33 rendered a remarkable elongation of sulfide, resulting in a worse performance on the machinability as compared to the present invention steel samples.

The sample No. 34 was set to have an O content of more than 0.0120%, which is outside the range of the O content according to the present invention. Consequently, the sample No. 34 rendered generation of streak flaws due to gigantic oxide, resulting in a larger number of surface flaws, i.e., a worse performance on the surface flaws as compared to the present invention steel samples.

The sample No. 35 was set to have an N content of 0.0070% or less, which is outside the range of the N content according to the present invention. Consequently, the sample No. 35 rendered a failure in causing the strain ageing, resulting in a worse performance on the machinability as compared to the present invention steel samples.

The sample No. 36 was set to have an N content of more than 0.0150%, which is outside the range of the N content according to the present invention. Consequently, the sample No. 36 rendered a deterioration in hot workability due to a large amount of AlN precipitated at the austenite grain boundary, resulting in a larger number of surface flaws, i.e., a worse performance on the surface flaws as compared to the present invention steel samples.

The sample No. 37 was set to have a value of less than 0.15%, in terms of the index of Si %+2×P %−(5×Al %+10×O %+3×N %), which is outside the corresponding range according to the present invention. Consequently, the sample No. 37 rendered a worse performance on the machinability as compared to the present invention steel samples.

The sample No. 38 was set to have a value of more than 0.75%, in terms of the index of Si %+2×P %−(5×Al %+10×O %+3×N %), which is outside the corresponding range according to the present invention. Consequently, the sample No. 38 rendered a larger number of surface flaws, i.e., a worse performance on the surface flaws as compared to the present invention steel samples.

The sample No. 39 was set to satisfy $S\% \leq ([Mn\%]^5)/15$, in terms of the index of $([Mn\%]^5)/15 < S\% < ([Mn\%]^5)/2$, which is outside the corresponding range according to the present invention. Consequently, the sample No. 39 rendered an unnecessarily increase in hardness, resulting in a worse performance on the machinability as compared to the present invention steel samples.

The sample No. 40 was set to satisfy $S\%\ ([Mn\%]^5)/2$, in terms of the index of $([Mn\%]^5)/15 < S\% < ([Mn\%]^5)/2$, which is outside the corresponding range according to the present invention. Consequently, the sample No. 40 rendered a deterioration in hot workability due to formation of, FeS, resulting in a larger number of surface flaws, i.e., a worse performance on the surface flaws as compared to the present invention steel samples.

Experiment 2

Tests Using the Steel Wires

Each of the steel wires having a diameter of 11.5 mm was worked to have a diameter of 10 mm by a drawing step and then subjected to a machinability test and a surface flaw test.

The machinability test was performed by use of conditions and examinations shown in Table 4. The surface flaw test was conducted by preparing 10 drawn wires cut in a length of 300 mm, and then measuring the total number of surface flaws thereon by visual inspection. Table 5 shows results of these tests.

As compared to the reference sample (RS) No. 82 consisting of SUM23L, each of the present invention samples (PS) Nos. 42 to 62 rendered a smaller number of surface flaws, i.e., a better performance on the surface flaws, and also rendered a better performance on the machinability including the chip manageability and finished surface roughness.

The samples Nos. 63 to 81 are comparative samples (CS). The sample No. 63 was set to have a C content of less than 0.04%, which is outside the range of the C content according to the present invention. Consequently, the sample No. 63 rendered an insufficient strength and a high ductility, resulting in a worse performance on the machinability as compared to the present invention steel samples.

The sample No. 64 was set to have a C content of more than 0.15%, which is outside the claimed range of the C content according to the present invention. Consequently, the sample No. 64 rendered a lager amount of pearlite, resulting in a worse performance on the machinability as compared to the present invention steel samples.

The sample No. 65 was set to have an Si content of 0.1% or less, which is outside the range of the Si content according to the present invention. Consequently, the sample No. 65 rendered a high ductility of the ferrite structure, resulting in a worse performance on the machinability as compared to the present invention steel samples.

The sample No. 66 was set to have an Si content of more than 0.7%, which is outside the range of the Si content according to the present invention. Consequently, the sample No. 66 rendered generation of streak flaws due to gigantic Si oxide, resulting in a larger number of surface flaws, i.e., a worse performance on the surface flaws as compared to the present invention steel samples.

The sample No. 67 was set to have an Mn content of less than 0.85%, which is outside the range of the Mn content according to the present invention. Consequently, the sample No. 67 rendered a smaller amount of sulfide, resulting in a worse performance on the machinability as compared to the present invention steel samples.

The sample No. 68 was set to have an Mn content of more than 1.50%, which is outside the range of the Mn content according to the present invention. Consequently, the sample No. 68 rendered an elongation of sulfide, resulting in a worse performance on the machinability as compared to the present invention steel samples.

The sample No. 69 was set to have a P content of less than 0.040%, which is outside the claimed range of the P content according to the present invention. Consequently, the sample No. 69 rendered failures in suppressing the formation of the built-up edge and in making the ferrite structure brittle, resulting in a worse performance on the machinability as compared to the present invention steel samples.

The sample No. 70 was set to have a P content of more than 0.120%, which is outside the range of the P content according to the present invention. Consequently, the sample No. 70 rendered a remarkable deterioration in hot workability, resulting in a larger number of surface flaws, i.e., a worse performance on the surface flaws as compared to the present invention steel samples.

The sample No. 71 was set to have an S content of less than 0.250%, which is outside the range of the S content according to the present invention. Consequently, the sample No. 70 rendered an insufficient amount of sulfide, resulting in a worse performance on the machinability as compared to the present invention steel samples.

The sample No. 72 was set to have an S content of 0.400% or more, which is outside the range of the S content according to the present invention. Consequently, the sample No. 72 rendered a remarkable deterioration in hot workability, resulting in a larger number of surface flaws, i.e., a worse performance on the surface flaws as compared to the present invention steel samples.

The sample No. 73 was set to have an Al content of 0.005% or more, which is outside the range of the Al content according to the present invention. Consequently, the sample No. 73 rendered generation of streak flaws due to gigantic Al oxide and a deterioration in hot workability due to AlN precipitated at the austenite grain boundary, resulting in a larger number of surface flaws, i.e., a worse performance on the surface flaws as compared to the present invention steel samples.

The sample No. 74 was set to have an O content of 0.0020% or less, which is outside the range of the O content according to the present invention. Consequently, the sample No. 74 rendered a remarkable elongation of sulfide, resulting in a worse performance on the machinability as compared to the present invention steel samples.

The sample No. 75 was set to have an O content of more than 0.0120%, which is outside the range of the O content according to the present invention. Consequently, the sample No. 75 rendered generation of streak flaws due to gigantic oxide, resulting in a larger number of surface flaws, i.e., a worse performance on the surface flaws as compared to the present invention steel samples.

The sample No. 76 was set to have an N content of 0.0070% or less, which is outside the range of the N content according to the present invention. Consequently, the sample No. 76 rendered a failure in causing the strain ageing, resulting in a worse performance on the machinability as compared to the present invention steel samples.

The sample No. 77 was set to have an N content of more than 0.0150%, which is outside the range of the N content according to the present invention. Consequently, the sample No. 77 rendered a deterioration in hot workability due to a large amount of AlN precipitated at the austenite grain boundary, resulting in a larger number of surface flaws, i.e., a worse performance on the surface flaws as compared to the present invention steel samples.

The sample No. 78 was set to have a value of less than 0.15%, in terms of the index of Si %+2×P %−(5×Al %+10×O %+3×N %), which is outside the corresponding range according to the present invention. Consequently, the sample No. 78 rendered a worse performance on the machinability as compared to the present invention steel samples.

The sample No. 79 was set to have a value of more than 0.75%, in terms of the index of Si %+2×P %−(5×Al %+10×O %+3×N %), which is outside the corresponding range according to the present invention. Consequently, the sample No. 79 rendered a larger number of surface flaws, i.e., a worse performance on the surface flaws as compared to the present invention steel samples.

The sample No. 80 was set to satisfy S %≤([Mn %]$^5$)/15, in terms of the index of ([Mn %]$^5$)/15<S %<([Mn %]$^5$)/2, which is outside the corresponding range according to the present invention. Consequently, the sample No. 80 rendered an unnecessarily increase in hardness, resulting in a worse performance on the machinability as compared to the present invention steel samples.

The sample No. 81 was set to satisfy S %≥([Mn %]$^5$)/2, in terms of the index of ([Mn %]$^5$)/15<S %<([Mn %]$^5$)/2, which is outside the corresponding range according to the present invention. Consequently, the sample No. 81 rendered a deterioration in hot workability due to formation of FeS, resulting in a larger number of surface flaws, i.e., a worse performance on the surface flaws as compared to the present invention steel samples.

TABLE 1

| No. | C | Si | Mn | P | S | Al | O | N | Pb | P1 Value (#2) | S content definition (#3) | (mass %) Category |
|---|---|---|---|---|---|---|---|---|---|---|---|---|
| 1 | 0.09 | 0.12 | 1.15 | 0.069 | 0.331 | 0.002 | 0.0048 | 0.0101 | 0 | 0.17 | 0.134 < S % < 1.01 | PS |
| 2 | 0.08 | 0.25 | 1.16 | 0.072 | 0.331 | 0.002 | 0.0048 | 0.0099 | 0 | 0.31 | 0.140 < S % < 1.05 | PS |
| 3 | 0.09 | 0.30 | 1.16 | 0.073 | 0.329 | 0.001 | 0.0049 | 0.0106 | 0 | 0.36 | 0.140 < S % < 1.05 | PS |
| 4 | 0.09 | 0.49 | 1.15 | 0.071 | 0.333 | 0.002 | 0.0049 | 0.0109 | 0 | 0.54 | 0.134 < S % < 1.01 | PS |
| 5 | 0.08 | 0.68 | 1.14 | 0.073 | 0.332 | 0.001 | 0.0047 | 0.0101 | 0 | 0.74 | 0.128 < S % < 0.963 | PS |
| 6 | 0.04 | 0.32 | 1.14 | 0.071 | 0.331 | 0.002 | 0.0079 | 0.0112 | 0 | 0.34 | 0.128 < S % < 0.963 | PS |
| 7 | 0.14 | 0.31 | 1.15 | 0.072 | 0.332 | 0.001 | 0.0045 | 0.0103 | 0 | 0.37 | 0.134 < S % < 1.01 | PS |
| 8 | 0.09 | 0.32 | 0.88 | 0.073 | 0.261 | 0.001 | 0.0044 | 0.0103 | 0 | 0.39 | 0.035 < S % < 0.264 | PS |
| 9 | 0.09 | 0.31 | 1.42 | 0.072 | 0.389 | 0.001 | 0.0047 | 0.0101 | 0 | 0.37 | 0.385 < S % < 2.89 | PS |
| 10 | 0.08 | 0.31 | 1.14 | 0.041 | 0.330 | 0.001 | 0.0048 | 0.0102 | 0 | 0.31 | 0.128 < S % < 0.963 | PS |
| 11 | 0.08 | 0.29 | 1.15 | 0.062 | 0.332 | 0.001 | 0.0046 | 0.0103 | 0 | 0.33 | 0.134 < S % < 1.01 | PS |
| 12 | 0.09 | 0.30 | 1.14 | 0.099 | 0.331 | 0.001 | 0.0047 | 0.0101 | 0 | 0.42 | 0.128 < S % < 0.963 | PS |
| 13 | 0.09 | 0.32 | 1.14 | 0.118 | 0.328 | 0.002 | 0.0047 | 0.0112 | 0 | 0.47 | 0.128 < S % < 0.963 | PS |
| 14 | 0.09 | 0.31 | 1.15 | 0.073 | 0.251 | 0.002 | 0.0049 | 0.0099 | 0 | 0.37 | 0.134 < S % < 1.01 | PS |
| 15 | 0.08 | 0.31 | 1.16 | 0.073 | 0.398 | 0.001 | 0.0044 | 0.0102 | 0 | 0.38 | 0.140 < S % < 1.05 | PS |
| 16 | 0.08 | 0.32 | 1.06 | 0.071 | 0.378 | 0.004 | 0.0047 | 0.0103 | 0 | 0.36 | 0.089 < S % < 0.669 | PS |
| 17 | 0.09 | 0.31 | 1.15 | 0.072 | 0.330 | 0.001 | 0.0022 | 0.0101 | 0 | 0.40 | 0.134 < S % < 1.01 | PS |
| 18 | 0.09 | 0.31 | 1.14 | 0.072 | 0.329 | 0.001 | 0.0089 | 0.0102 | 0 | 0.33 | 0.128 < S % < 0.963 | PS |
| 19 | 0.08 | 0.32 | 1.16 | 0.071 | 0.330 | 0.002 | 0.0118 | 0.0103 | 0 | 0.30 | 0.140 < S % < 1.05 | PS |
| 20 | 0.09 | 0.31 | 1.15 | 0.072 | 0.332 | 0.002 | 0.0047 | 0.0072 | 0 | 0.38 | 0.134 < S % < 1.01 | PS |
| 21 | 0.09 | 0.31 | 1.14 | 0.072 | 0.331 | 0.001 | 0.0047 | 0.0147 | 0 | 0.36 | 0.128 < S % < 0.963 | PS |
| 22 | 0.01* | 0.32 | 1.14 | 0.072 | 0.328 | 0.003 | 0.0045 | 0.0109 | 0 | — | — | CS |
| 23 | 0.31* | 0.32 | 1.15 | 0.072 | 0.331 | 0.001 | 0.0049 | 0.0101 | 0 | — | — | CS |
| 24 | 0.09 | 0.05* | 1.14 | 0.073 | 0.331 | 0.001 | 0.0044 | 0.0112 | 0 | — | — | CS |
| 25 | 0.09 | 0.98* | 1.14 | 0.072 | 0.331 | 0.001 | 0.0047 | 0.0103 | 0 | — | — | CS |

TABLE 1-continued

| No. | C | Si | Mn | P | S | Al | O | N | Pb | P1 Value (#2) | S content definition (#3) | (mass %) Category |
|---|---|---|---|---|---|---|---|---|---|---|---|---|
| 26 | 0.08 | 0.32 | 0.25* | 0.071 | 0.331 | 0.001 | 0.0048 | 0.0102 | 0 | — | — | CS |
| 27 | 0.08 | 0.31 | 1.95* | 0.072 | 0.331 | 0.001 | 0.0046 | 0.0103 | 0 | — | — | CS |
| 28 | 0.08 | 0.31 | 1.14 | 0.015* | 0.329 | 0.002 | 0.0047 | 0.0101 | 0 | — | — | CS |
| 29 | 0.09 | 0.29 | 1.15 | 0.189* | 0.333 | 0.002 | 0.0045 | 0.0102 | 0 | — | — | CS |
| 30 | 0.09 | 0.30 | 1.14 | 0.073 | 0.108* | 0.001 | 0.0049 | 0.0103 | 0 | — | — | CS |
| 31 | 0.09 | 0.32 | 1.14 | 0.072 | 0.541* | 0.003 | 0.0044 | 0.0101 | 0 | — | — | CS |
| 32 | 0.08 | 0.31 | 1.15 | 0.071 | 0.332 | 0.023* | 0.0047 | 0.0112 | 0 | — | — | CS |
| 33 | 0.08 | 0.31 | 1.16 | 0.072 | 0.332 | 0.001 | 0.0008* | 0.0099 | 0 | — | — | CS |
| 34 | 0.08 | 0.32 | 1.16 | 0.072 | 0.261 | 0.002 | 0.0209* | 0.0102 | 0 | — | — | CS |
| 35 | 0.09 | 0.31 | 1.15 | 0.072 | 0.389 | 0.002 | 0.0047 | 0.0035* | 0 | — | — | CS |
| 36 | 0.09 | 0.31 | 1.14 | 0.073 | 0.330 | 0.001 | 0.0047 | 0.0222* | 0 | — | — | CS |
| 37 | 0.08 | 0.12 | 1.14 | 0.082 | 0.331 | 0.004 | 0.0088 | 0.0148 | 0 | 0.13* | $0.128 < S\ \% < 0.963$ | CS |
| 38 | 0.08 | 0.68 | 1.15 | 0.088 | 0.329 | 0.001 | 0.0041 | 0.0083 | 0 | 0.79* | $0.134 < S\ \% < 1.01$ | CS |
| 39 | 0.08 | 0.31 | 1.41 | 0.071 | 0.251 | 0.001 | 0.0045 | 0.0105 | 0 | 0.37 | $0.372 < S\ \% < 2.79$* | CS |
| 40 | 0.08 | 0.30 | 0.91 | 0.072 | 0.343 | 0.001 | 0.0046 | 0.0103 | 0 | 0.36 | $0.042 < S\ \% < 0.312$ | CS |
| 41 | 0.09 | 0.01 | 1.21 | 0.073 | 0.321 | 0.001 | 0.0157 | 0.0123 | 0.2 | — | — | RS |

(#1) The symbol "*" denotes that the value is outside the range according to the present invention.
(#2) $P_1 = Si\ \% + 2 \times P\ \% - (5 \times Al\ \% + 10 \times O\ \% + 3 \times N\ \%)$, wherein $0.15 \leq P_1 \leq 0.75$ is the range according to the present invention.
(#3) The S content definition is expressed by $([Mn\ \%]^5)/15 < S\ \% < ([Mn\ \%]^5)/2$.

TABLE 2

| Item | Tool material | Cutting conditions: Feed (mm/rev) | Incision (mm) | Cutting speed (m/min) | Cutting time (min) | Lubricant | Examinaion method |
|---|---|---|---|---|---|---|---|
| Periphery turn-cutting | Ultra-hard P20 | 0.20 | 2.0 | 150 | (See examination method) | No | Service life: The cutting time when the front flank wear amount VB became 0.2 mm. |
| | | 0.10<br>0.20<br>0.30 | 2.0 | 30, 50, 100, 150, 200 | 1 | No | Rating of the cut chip shape (the total of 15 cutting conditions (#5))<br>One chip length of less than 30 mm: 1 point<br>One chip length of 30 mm or more: 3 points |
| | | 0.02 | 2.0 | 100 | 1 | No | Maximum surface roughness Rz |
| | SKH4 | 0.20 | 2.0 | 80 | (See examination method) | No | Service life: The cutting time when the cutting was disabled. |
| Hole drilling | SKH51 (ϕ10) | 0.35 | 25#4) | 20~80 | 0.0125~0.050 | Aqueous lubricant | Service life: The cutting speed where the cutting was disabled at a total drilled hole depth of 1,000 mm. |

#4)The hole dept of each hole (non-penetration): The drilling direction was aligned with the rolling direction. (The material was cut in a thickness of 30 mm and drilled from the cut surface.)
(#5) 3 feed conditions × 5 cutting speed conditions = 15 cutting conditions

TABLE 3

| No. | Cutting tool service life: P20 life in periphery cutting (min) | SKH4 life in Peripehery cutting | Drill life (m/min) | Cut chip: dispos-ability Rating of chips (point) | Surface rough-ness Rz (μm) | Number of surface flaws (piece) | Cat-egory |
|---|---|---|---|---|---|---|---|
| 1 | 47 | 39 | 49 | 15 | 7 | 0 | PS |
| 2 | 45 | 35 | 47 | 15 | 6 | 0 | PS |
| 3 | 44 | 34 | 45 | 15 | 6 | 0 | PS |
| 4 | 43 | 33 | 44 | 15 | 6 | 0 | PS |
| 5 | 42 | 32 | 42 | 15 | 6 | 0 | PS |
| 6 | 40 | 30 | 40 | 17 | 7 | 0 | PS |
| 7 | 40 | 30 | 40 | 15 | 7 | 22 | PS |
| 8 | 40 | 30 | 40 | 17 | 7 | 0 | PS |
| 9 | 42 | 32 | 43 | 15 | 7 | 0 | PS |
| 10 | 43 | 33 | 44 | 15 | 7 | 0 | PS |
| 11 | 44 | 34 | 45 | 15 | 7 | 0 | PS |
| 12 | 44 | 35 | 45 | 15 | 6 | 10 | PS |
| 13 | 44 | 35 | 45 | 15 | 6 | 21 | PS |
| 14 | 43 | 33 | 43 | 17 | 7 | 0 | PS |
| 15 | 44 | 34 | 46 | 15 | 6 | 0 | PS |
| 16 | 45 | 35 | 42 | 15 | 7 | 0 | PS |

TABLE 3-continued

| No. | Cutting tool service life: P20 life in periphery cutting (min) | SKH4 life in Peripehery cutting | Drill life (m/min) | Cut chip: dispos-ability Rating of chips (point) | Surface rough-ness Rz (μm) | Number of surface flaws (piece) | Cat-egory |
|---|---|---|---|---|---|---|---|
| 17 | 43 | 33 | 44 | 15 | 7 | 0 | PS |
| 18 | 44 | 34 | 46 | 15 | 6 | 14 | PS |
| 19 | 45 | 35 | 47 | 15 | 6 | 29 | PS |
| 20 | 44 | 35 | 44 | 15 | 7 | 0 | PS |
| 21 | 45 | 35 | 46 | 15 | 6 | 0 | PS |
| 22 | 22 | 12 | 14 | 25 | 14 | 0 | CS |
| 23 | 21 | 11 | 12 | 25 | 14 | 0 | CS |
| 24 | 30 | 22 | 31 | 28 | 10 | 0 | CS |
| 25 | 25 | 16 | 24 | 25 | 10 | 75 | CS |
| 26 | 32 | 24 | 33 | 30 | 15 | 0 | CS |
| 27 | 19 | 10 | 16 | 31 | 14 | 0 | CS |
| 28 | 33 | 21 | 32 | 25 | 19 | 0 | CS |
| 29 | 33 | 19 | 29 | 23 | 15 | 66 | CS |
| 30 | 30 | 21 | 31 | 31 | 14 | 0 | CS |
| 31 | 33 | 23 | 33 | 21 | 15 | 105 | CS |
| 32 | 33 | 12 | 18 | 21 | 16 | 93 | CS |

TABLE 3-continued

| No. | Cutting tool service life: P20 life in periphery cutting (min) | Cutting tool service life: SKH4 life in Peripehery cutting | Drill life (m/min) | Cut chip: dispos-ability Rating of chips (point) | Surface rough-ness Rz (μm) | Number of surface flaws (piece) | Cat-egory |
|---|---|---|---|---|---|---|---|
| 33 | 30 | 20 | 29 | 23 | 15 | 0 | CS |
| 34 | 27 | 18 | 26 | 22 | 14 | 165 | CS |
| 35 | 32 | 20 | 27 | 30 | 16 | 0 | CS |
| 36 | 34 | 21 | 29 | 27 | 15 | 81 | CS |
| 37 | 32 | 21 | 31 | 26 | 14 | 0 | CS |
| 38 | 32 | 21 | 30 | 25 | 14 | 69 | CS |
| 39 | 21 | 11 | 19 | 25 | 15 | 0 | CS |
| 40 | 32 | 22 | 29 | 26 | 15 | 156 | CS |
| 41 | 36 | 26 | 36 | 19 | 8 | 45 | RS |

TABLE 5-continued

| No. | Cutting tool service life: P20 life in periphery cutting (min) | Cutting tool service life: Drill life (hole) | Cut chip: disposability Rating of chips (point) | Surface roughness Rz (μm) | Number of surface flaws (piece) | Category |
|---|---|---|---|---|---|---|
| 68 | 2.1 | 185 | 30 | 7 | 0 | CS |
| 69 | 3.3 | 360 | 24 | 9 | 0 | CS |
| 70 | 3.3 | 327 | 23 | 7 | 132 | CS |
| 71 | 3.1 | 349 | 30 | 7 | 0 | CS |
| 72 | 3.3 | 371 | 21 | 7 | 216 | CS |
| 73 | 3.3 | 206 | 21 | 8 | 189 | CS |
| 74 | 3.1 | 328 | 22 | 7 | 0 | CS |
| 75 | 2.8 | 292 | 22 | 7 | 327 | CS |
| 76 | 3.2 | 304 | 30 | 8 | 0 | CS |
| 77 | 3.4 | 328 | 27 | 7 | 165 | CS |
| 78 | 3.2 | 350 | 26 | 7 | 0 | CS |

TABLE 4

| Item | Tool material | Cutting conditions: Feed (mm/rev) | Incision (mm) | Cutting speed (m/min) | Cutting time (min) | Lubricant | Examinaion method |
|---|---|---|---|---|---|---|---|
| Periphery turn-cutting | Ultra-hard P20 | 0.05 | 1.0 | 70 | (See examination method) | No | Service life: The cutting time when the front flank wear amount VB became 0.2 mm. |
| | | | | | 1 | No | Rating of the cut chip shape<br>One chip length of less than 30 mm: 1 point<br>One chip length of 30 mm or more: 3 points |
| | | | | | 1 | No | Maximum surface roughness Rz |
| Hole drilling | SKH51 (φ2) | 0.02 | 10[#6)] | 15 | (See examination method) | Aqueous lubricant | Service life: The number of holes until the cutting was disabled. |

[#6)]The hole dept of each hole (penetration): The drilling direction was orthogonal to the drawing direction. (The material was cut in a length of 50 mm and drilled from the side surface.)

TABLE 5

| No. | Cutting tool service life: P20 life in periphery cutting (min) | Cutting tool service life: Drill life (hole) | Cut chip: disposability Rating of chips (point) | Surface roughness Rz (μm) | Number of surface flaws (piece) | Category |
|---|---|---|---|---|---|---|
| 42 | 4.6 | 548 | 15 | 4 | 0 | PS |
| 43 | 4.4 | 526 | 15 | 3 | 0 | PS |
| 44 | 4.3 | 514 | 15 | 3 | 0 | PS |
| 45 | 4.2 | 492 | 15 | 3 | 0 | PS |
| 46 | 4.1 | 470 | 15 | 3 | 0 | PS |
| 47 | 3.9 | 450 | 17 | 4 | 0 | PS |
| 48 | 3.9 | 448 | 15 | 4 | 45 | PS |
| 49 | 3.9 | 452 | 17 | 3 | 0 | PS |
| 50 | 4.1 | 481 | 15 | 3 | 0 | PS |
| 51 | 4.2 | 493 | 15 | 4 | 0 | PS |
| 52 | 4.3 | 503 | 15 | 3 | 0 | PS |
| 53 | 4.3 | 515 | 15 | 3 | 21 | PS |
| 54 | 4.3 | 517 | 15 | 3 | 46 | PS |
| 55 | 4.2 | 483 | 17 | 3 | 0 | PS |
| 56 | 4.3 | 514 | 15 | 3 | 0 | PS |
| 57 | 4.4 | 472 | 15 | 3 | 0 | PS |
| 58 | 4.2 | 494 | 15 | 3 | 0 | PS |
| 59 | 4.4 | 516 | 15 | 3 | 25 | PS |
| 60 | 4.5 | 519 | 15 | 3 | 57 | PS |
| 61 | 4.3 | 490 | 15 | 4 | 0 | PS |
| 62 | 4.4 | 513 | 15 | 3 | 0 | PS |
| 63 | 2.3 | 162 | 25 | 7 | 0 | CS |
| 64 | 2.2 | 141 | 25 | 7 | 0 | CS |
| 65 | 3.1 | 350 | 28 | 5 | 0 | CS |
| 66 | 2.6 | 272 | 25 | 5 | 153 | CS |
| 67 | 3.2 | 372 | 30 | 8 | 0 | CS |

TABLE 5-continued

| No. | Cutting tool service life: P20 life in periphery cutting (min) | Cutting tool service life: Drill life (hole) | Cut chip: disposability Rating of chips (point) | Surface roughness Rz (μm) | Number of surface flaws (piece) | Category |
|---|---|---|---|---|---|---|
| 79 | 3.2 | 338 | 25 | 7 | 174 | CS |
| 80 | 2.2 | 217 | 25 | 7 | 0 | CS |
| 81 | 3.2 | 327 | 25 | 7 | 318 | CS |
| 82 | 3.7 | 404 | 18 | 5 | 93 | RS |

The invention claimed is:

1. A low carbon resulfurized free cutting steel consisting of 0.04 to 0.15% of C, 0.31% to 0.70% of Si, 0.85 to 1.50% of Mn, 0.040 to 0.120% of P, 0.250% to less than 0.400% of S, less than 0.005% of Al, 0.0044% to 0.0120% of 0, and 0.0099% to 0.0150% of N, all by mass percentage, and the balance of Fe and inevitable impurities, and satisfying a formula (1) and a formula (2), as follows:

$$0.36\% \leq Si\,\% + 2 \times P\,\% - (5 \times Al\,\% + 10 \times O\,\% + 3 \times N\,\%) \leq 0.75\% \quad (1), \text{ and}$$

$$([Mn\,\%]^5)/15 < S\,\% < ([Mn\,\%]^5)/2 \quad (2).$$

2. The free cutting steel according to claim 1, wherein the free cutting steel has a C content of less than 0.10% by mass percentage.

3. The free cutting steel according to claim 1, wherein, the free cutting steel has a Si content of less than 0.50% by mass percentage.

4. The free cutting steel according to claim 1, wherein the free cutting steel has a P content of 0.100% or less by mass percentage.

5. The free cutting steel according to claim 1, wherein the free cutting steel has an O content of less than 0.0090% by mass percentage.

6. The free cutting steel according to claim 1, wherein the free cutting steel has an O content of less than 0.0050% by mass percentage.

7. The free cutting steel according to claim 1, wherein the free cutting steel satisfies $S\% < ([Mn\%]^5)/3.5$ in terms of the formula (2).

8. The free cutting steel according to claim 1, wherein the free cutting steel satisfies $Si\% + 2 \times P\% - (5 \times Al\% + 10 \times O\% + 3 \times N\%) \leq 0.54\%$ in terms of the formula (1).

9. The free cutting steel according to claim 1, wherein the free cutting steel has a Si content of less than 0.50% by mass percentage, and the free cutting steel satisfies $S\% < ([Mn\%]^5)/3.5$ in terms of the formula (2).

10. A low carbon resulfurized free cutting steel consisting of 0.04% to less than 0.10% of C, 0.31% to 0.70% of Si, 0.85 to 1.50% of Mn, 0.040 to 0.073% of P, 0.250% to less than 0.400% of S, less than 0.005% of Al, 0.0044% to 0.0079% of 0, and 0.0099% to 0.0150% of N, all by mass percentage, and the balance of Fe and inevitable impurities, and satisfying a formula (1) and a formula (2), as follows:

$$0.36\% \leq Si\% + 2 \times P\% - (5 \times Al\% + 10 \times O\% + 3 \times N\%) \leq 0.75\% \quad (1), \text{ and}$$

$$([Mn\%]^5)/15 < S\% < ([Mn\%]^5)/2 \quad (2).$$

11. The free cutting steel according to claim 10, wherein the free cutting steel satisfies $S\% < ([Mn\%]^5)/3.5$ in terms of the formula (2).

12. The free cutting steel according to claim 10, wherein the free cutting steel satisfies $Si\% + 2 \times P\% - (5 \times Al\% + 10 \times O\% + 3 \times N\%) \leq 0.54\%$ in terms of the formula (1).

13. The free cutting steel according to claim 10, wherein the free cutting steel has an O content of less than 0.0050% by mass percentage.

14. The free cutting steel according to claim 10, wherein the free cutting steel has an Si content of less than 0.50% by mass percentage.

* * * * *